United States Patent [19]

Steinhilber

[11] 4,323,162

[45] Apr. 6, 1982

[54] MULTIPLE-TROUSER-HANGER

[76] Inventor: Jiri Steinhilber, P/zza Duoma, 20 Milano, Italy

[21] Appl. No.: 68,055

[22] Filed: Aug. 20, 1979

[30] Foreign Application Priority Data

Sep. 11, 1978 [IT] Italy ..... 27500 A/78
Sep. 28, 1978 [IT] Italy ..... 28084 A/78

[51] Int. Cl.[3] ..... A47F 7/19
[52] U.S. Cl. ..... 211/100; 211/104
[58] Field of Search ..... 211/99, 100, 116

[56] References Cited

U.S. PATENT DOCUMENTS

| | | | |
|---|---|---|---|
| 624,908 | 5/1899 | Conchar | 211/99 |
| 1,466,859 | 9/1923 | Sutton | 211/99 |
| 1,634,746 | 7/1927 | Harris | 211/100 |
| 2,615,579 | 10/1952 | Sampson | 211/100 |
| 3,211,295 | 10/1965 | Weiss | 211/100 |
| 3,794,182 | 2/1974 | Royeton | 211/116 X |
| 3,976,200 | 8/1976 | Munns | 211/100 X |

FOREIGN PATENT DOCUMENTS

| | | | |
|---|---|---|---|
| 172884 | 9/1960 | Sweden | 211/100 |
| 306609 | 7/1955 | Switzerland | 211/99 |

*Primary Examiner*—Roy D. Frazier
*Assistant Examiner*—Robert W. Gibson, Jr.
*Attorney, Agent, or Firm*—Michael J. Striker

[57] ABSTRACT

Multiple domestic trouser-hanger comprising a certain number, preferably five, of horizontal bars, one bar for each pair of trousers, adequately spaced one from another, projecting from and fixed to an arm held by an articulated joint to a base which can be fixed to any wall and which can take up two main, self-locking positions according to whether the plane on which it is fixed is vertical or horizontal.

7 Claims, 16 Drawing Figures

FIG. 9
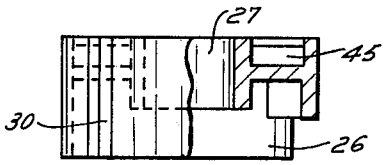
FIG. 11
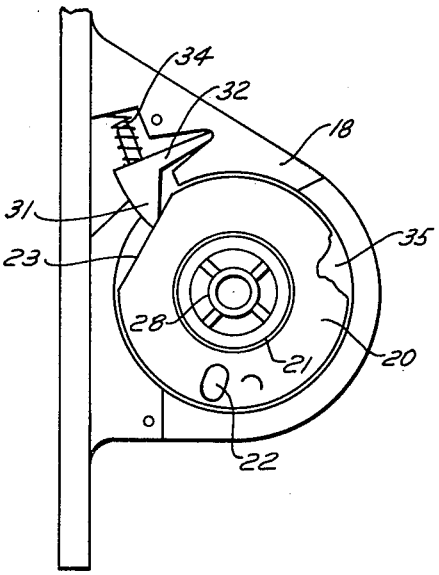
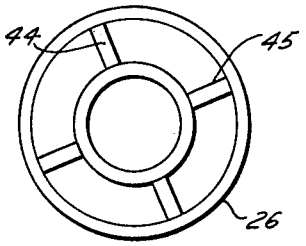
FIG. 10

MULTIPLE-TROUSER-HANGER

DESCRIPTION

BACKGROUND OF THE INVENTION

The ordinary trouser-hanger used in the home can only take one pair of trousers. Both the clip types and those consisting for a cross bar added to a normal coat-hanger can in fact take not more than two pairs of trousers at the very most.

SUMMARY OF THE INVENTION

It is an object of the invention to provide an improved household trouser-hanger for a number of trousers hung on the hanger.

Another object of the invention is to provide a trouser-hanger of relatively simple but reliable structure which may be placed in two self-locking positions for hanging over or taking off the trousers.

These and other objects are attained by a trouser-hanger which comprises a plurality of parallel horizontal elongated hanging bars, a supporting arm connected to the bars and disposed normally to the bars, a joint connected to the arm and adapted to pivotally support the arm on one of said bars, and a wall-mountable bracket arranged to receive the joint and having a horizontal pin. The joint positioned within a substantially cylindrical chamber provided in the bracket includes a cylindrical member and a disc coaxially mounted on said pin and a pawl biased by a spring. The cylindrical member is formed with a longitudinal slot, and the disc is provided with a cut so that when the joint is pivotally rotated on the horizontal pin due to a swivelling movement of the supporting arm the pawl is arrested within the slot of the cylindrical member and pressed against the cut of the disc when the arm is in its horizontal self-locking position or released from said slot and said cut when the arm is in its vertical self-locking position.

The invention here described consists of a device suitable for hanging a certain number of pairs of trousers, each one hung separately from the others though the whole only occupies approximately the same space as that needed for one trouser-hanger.

The invention includes a certain number of suitably spaced projecting bars fixed to an arm revolving on a vertical plane around an articulated joint. The bars remain horizontal and parallel in the two main positions the arm can assume, namely one vertically downwards and one horizontal. One pair of trousers can be hung on each bar.

The figures in the enclosed drawings further show, by a practical example, how the invention works:

BRIEF DESCRIPTION OF THE DRAWINGS

FIG. 9 is a sectional view of the cylindrical block, shown in FIG. 5;

FIG. 10 is a back view of the cylindrical block shown in FIG. 5;

FIG. 11 is a side view of the assembly of a joint with a bracket in accordance with the invention;

DETAILED DESCRIPTION OF THE PREFERRED EMBODIMENT

Figure 2:
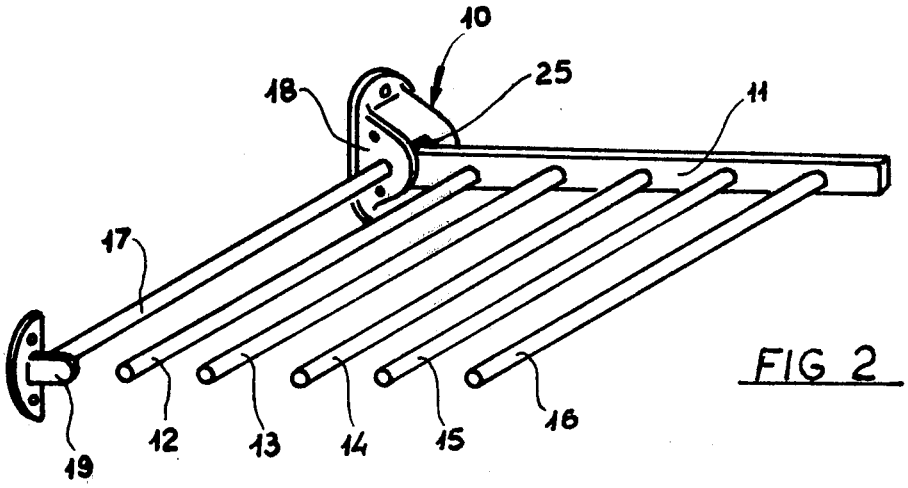
FIG. 2: Perspective of the device with the horizontal bars aligned on a horizontal plane.

An arm (11) with its fixed horizontal bars (12), (13), (14), (15), (16) moves on a joint (10).

The articulated joint substantially consists of a casing, which can be easily fixed to a vertical plane (panel, wall), enclosing a horizontal pin 28 around which a cylindrical block 26 can turn; arm 11 supporting the horizontal bars is firmly fixed to the cylindrical block.

A bar (17) is supported at its two ends respectively by a joint casing (18) and by the wall-mountable fitting (19). A disc (20) with a depressed zone 23 can rotate on a raised ring (21) situated at the bottom of a casing 18. On the rotating cylindrical block (26) which rotates through the hole (27) on a pin (28) lying horizontally in the casing 18, there is a slot (30) in which a tip (31) of a pawl (32) can be inserted. This pawl is set in a recess (33) while a spring (34) presses a tip (31) causing it to emerge from the slit (41) in a cylindrical chamber (35) inside which the cylindrical block (26) rotates pressing up against the cylindrical surface of the chamber. The cylindrical block 26 is fixed to the arm (11) by means of screws or something similar. Through holes (37), (38) and threaded holes (39), (40) of the casing, a cover (36) is fixed to the casing 18 by screws. A pin (22) can be seen on the disc (20) and this pin is served by two stops 44, 45 shown in the FIG. 10 and formed by ribs placed at a distance (measured over the circular trajectory which the pin takes) of about 45°. The point at which the stop is placed, towards the end of the arm, is such that when the arm is turned upwards, the disc is so pulled along by the stop as to maintain alignment of the depressed zone (23) of the disc 20, (in the form of a "circular segment") with the slot (30) in the cylindrical block; thus when the arm is lying horizontal, the tip (31) of the pawl (32) enters the slot and gives sufficient support to the arm and holds it straight enabling it to withstand the weight of all the trousers that can be folded over the bars projecting outwards from the arm. To release the arm from the horizontal position, all that is required is to raise it, utilizing a fissure (24), (FIG. 1) into a free area (25) above it. By thus lifting the arm, the resulting presence of a circular zone (42) of the pawl 32 enables the pawl (32) to leave the slot (30).

In operation, when the arm is rotated together with the cylindrical block 26 a frontal slit 41 in the casing allows the arm 11 to take the vertical or the horizontal position. A pawl 32 fitted in the casing is pushed by a spring 34 towards the inside of the cylindrical chamber 35 in which the cylindrical block 26 can turn. When the arm 11 is in the horizontal position, the pawl 32 enters a slot 30 in the block and this holds the arm in place. A disc 20 serves for releasing the device. The disc 20, the diameter of which is the same as that of the cylindrical block 26, has a hole which enables it to rotate around a ring 21 built in the inside of the casing 18 and concentric with the horizontal pin 28 mentioned above. The small pin 22 projecting from the surface of the disc 20 counterposed to one of the two lateral surfaces of the block 26, is served by two stops fixed to the above lateral surface. The disc 20 is thus forced to rotate together with the block 26 except along an arc of about 45° comprised between the two stops. The disc 20 has a depression 23 in the shape of a circular segment, i.e. like the area comprised between a bow and its string. When the arm is pushed upwards this depression is held by one of the stops in a position of alignment with the slot in the block and in this way the pawl can enter the slot.

It follows from the above that, to release the arm 11, from the horizontal position, all that is needed is to push it upwards as the curved edge of the pawl 32 allows this latter to leave the slot.

When the arm 11 is bent downwards the disc 20 remains unmoved till the second stop on the cylindrical block 26 has reached the pin 22 projecting from the disc. This point is reached only when the slot 30 on the cylindrical block 26 has passed the pawl 32 which, coming up against an undepressed arc of the disc, cannot enter the slot 30 and the arm 11 can therefore be lowered to a vertical position.

If the arm 11 is brought back up to the horizontal position the disc 20 resumes its higher position keeping the depressed part 23 aligned with the slot 30 in the cylindrical block 26 thus permitting insertion of the pawl 32 the thickness of which is roughly the same as the sum of the thicknesses of the cylindrical block and the disc together.

Figure 1:
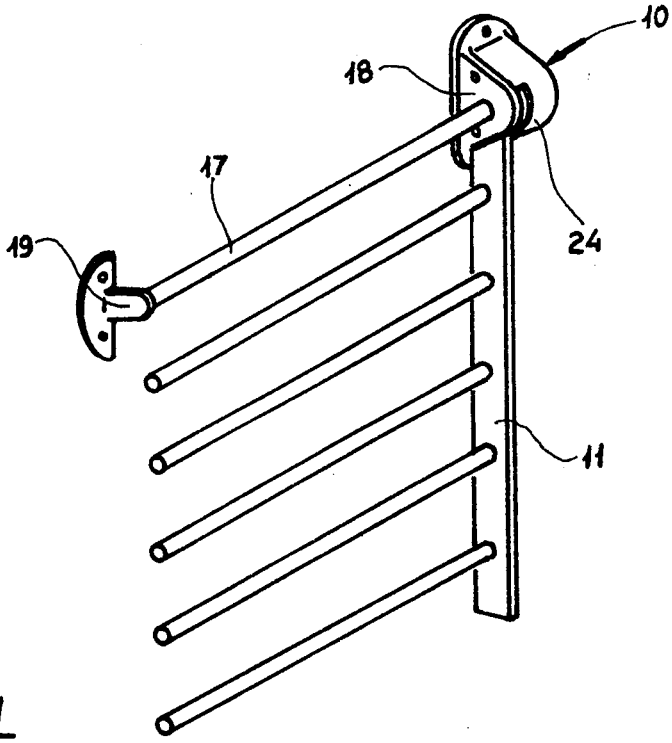
FIG. 1: the device seen in perspective with the horizontal bars aligned on a vertical plane.
Figure 2:
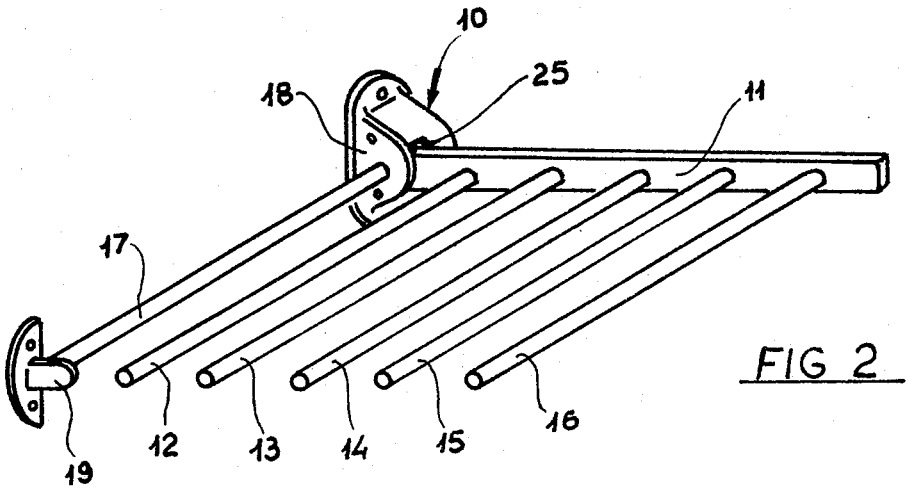
Figure 1:
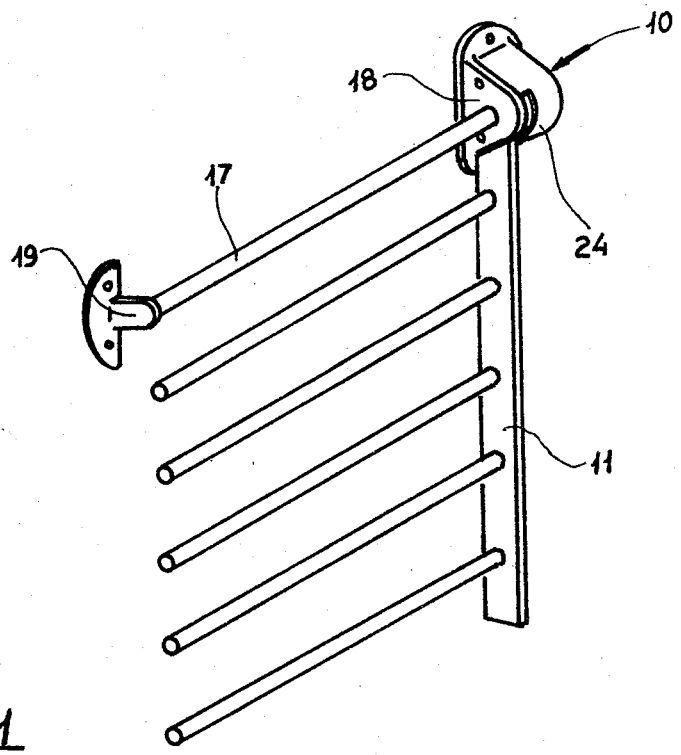
Figure 3:
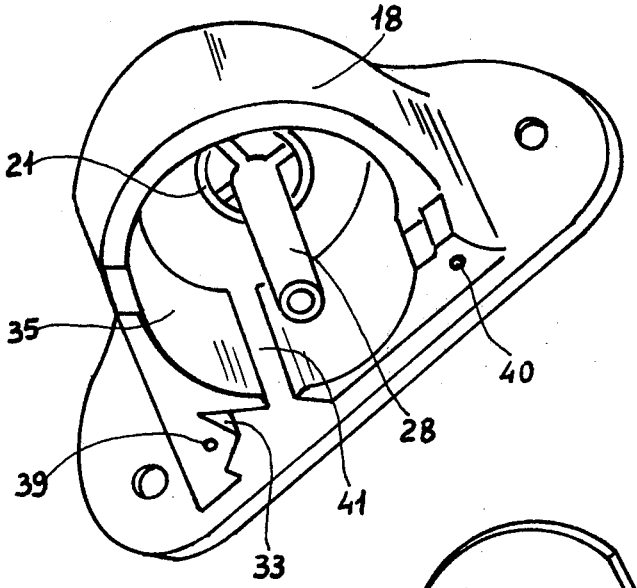
FIG. 3: is a perspective view of the articulated joint.
Figure 4:
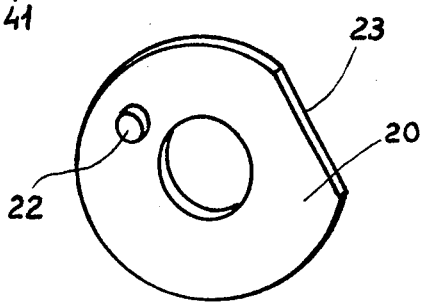
FIG. 4: Internal locking disc.
Figures 6, 7:
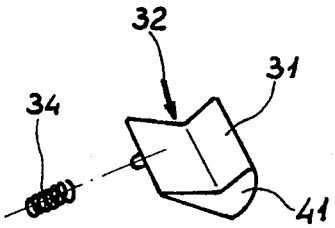
FIG. 6: Locking pawl.
FIG. 7: Spring.
Figure 5:
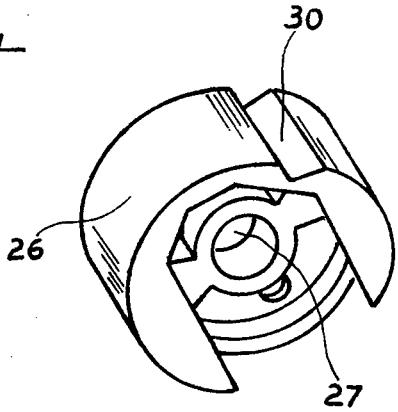
FIG. 5: Cylindrical block.
Figure 8:
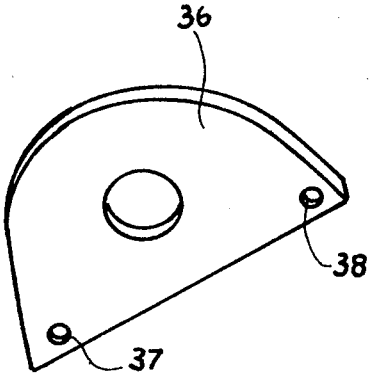
FIG. 8: Cover.
Figure 3:
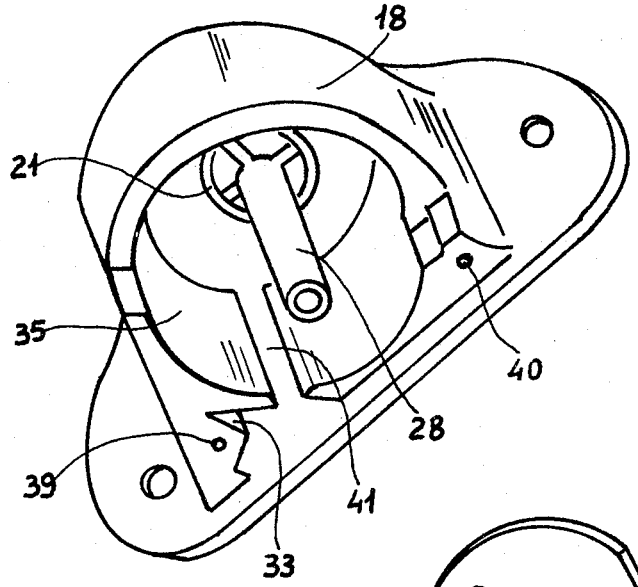
Figure 4:
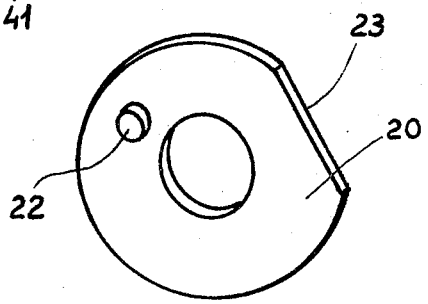
Figures 6, 7:
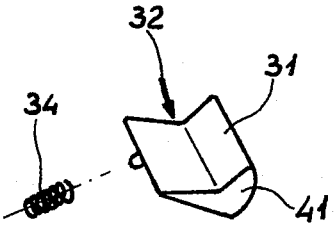
Figure 5:
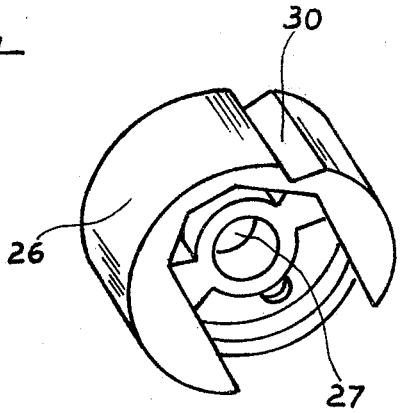
Figure 8:
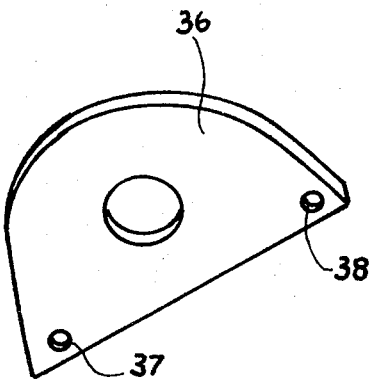
Figure 12:
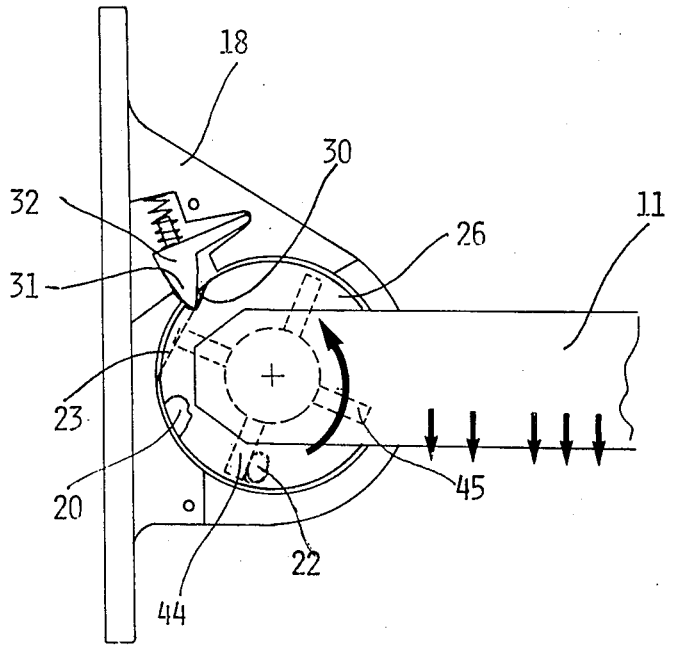
FIG. 12 is a side view of the assembly when a supporting arm is in its horizontal position.

When the arm is moved down again, the disc 20 remains still so that the pawl is up against a full arc and remains so until the slot (30) has passed the area occupied by the pawl (32). The latter cannot therefore enter the slot and the arm can be lifted to its second working position, namely vertical as shown in FIG. 1. It is clear from FIG. 13 that arm (11), firmly fixed to the block (26), is kept in its horizontal "working" position (i.e. able to withstand the weight of the trousers), by means of the tip (31) of pawl (32).

Figure 14:
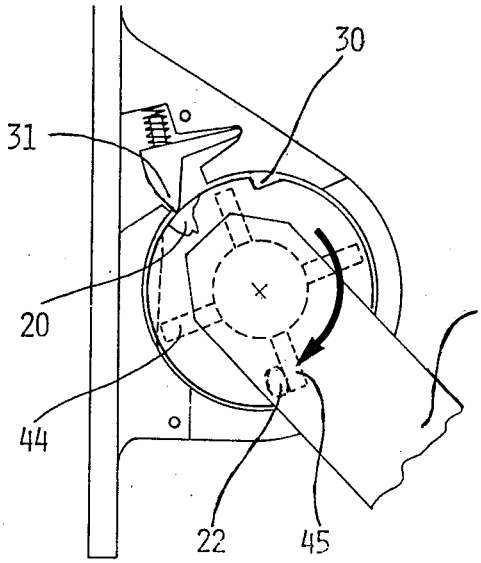
Figure 16:
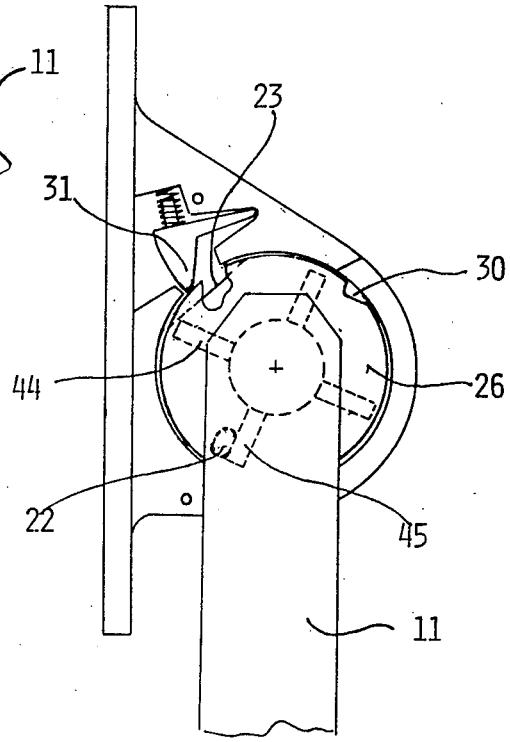
FIG. 16 is a side view of the assembly when the supporting arm is in its vertical position.

To move arm (11) to its resting position (as shown in FIG. 16), this being vertically downward, it must first of all be moved upwards to the position as shown in FIG. 14. When this is done the action of the radial stop (44) on the pin (22) causes disc (20) to rotate together with block (26).

At this point tip (31) is out of slot (30) and has simultaneously moved over against the cylindrical surface of block (26) and of disc (20).

Figure 15:
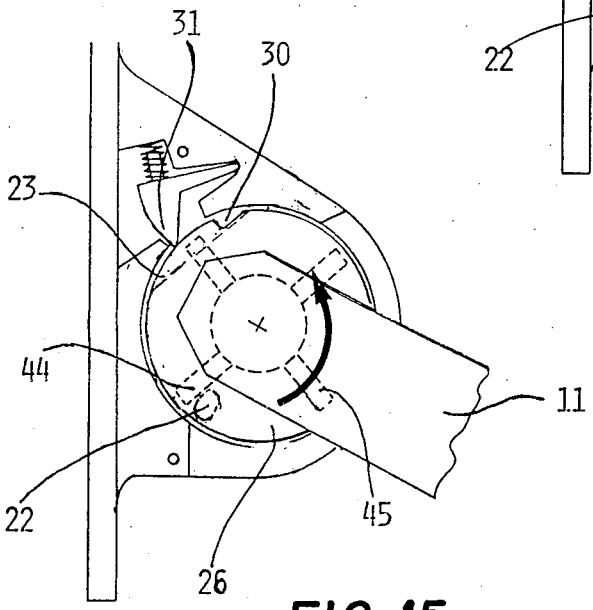

As FIG. 15 clearly shows, when the arm is moved downwards disc (20) remains stationary preventing tip (31) from entering slot (30) when it passes in front of the tip. By continuing to lower the arm 11 down to the position seen in FIG. 16, radial stop (45) acts on the pin (22) and this moves disc (20) bringing its cut or depression (23) opposite the tip (31).

Force of gravity keeps arm (11) steady in its vertical resting position.

Figure 13:
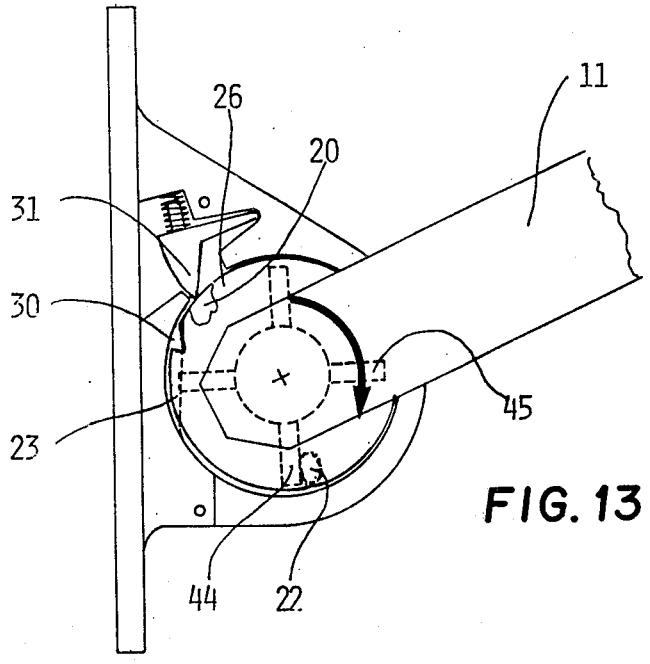
FIGS. 13–15, each shows a side view of the assembly in corresponding intermediate positions of the arm.

When arm (11) has to be returned to its working position, as in FIG. 13, it just has to be lifted up in a direction shown by an arrow in FIG. 17. The radial stop (44) of block (26) acts on the pin (22) of the disc until, as appears in FIG. 13, the depression (23) of the disc 20 is brought up against tip (31) allowing the tip to enter slot (30) of block (26) thus locking the arm in its operating position and preventing it from accidentally dropping downwards.

To restore the arm to its resting position, proceed as already described. The device can be made in various materials: wood, metal, plastic or others as, for example, the hinge can be in plastic or metal, the projecting bars of wood and the arm of metal.

The advantages of the invention are clearly evident; not only can it take a considerable number of trousers, but the trousers themselves can be easily put on and taken off seeing that the bars project and are entirely free at one end. As the trousers do not completely overlap and can be seen, it is easy to choose which pair is desired. The space occupied is more or less the same as that taken up by a single trouser-hanger. Two working positions can be used, the first with the bars disposed on a vertical plane, the second with the arm lying horizontally and thus with the bars disposed on a horizontal plane at 90° in relation to the first position. The device therefore ensures maximum practicality, minimum bulk in the vertical position when out of use, maximum ease in taking off trousers when the device is in the horizontal position as already indicated.

As the applications envisaged for the device have been described as examples of use only and are in no way limiting, it is understood that any and every equivalent application of the inventive concepts set forth, and any product constructed and/or operating in accordance with the characteristics possessed by the invention, are covered by the protection accorded to it.

I claim:

1. A household trouser-hanger comprising a plurality of parallel horizontal elongated hanging bars; a supporting arm connected to said bars and disposed normally to said elongated bars; a joint connected to said arm and adapted to pivotally support said arm at one of said bars at one end thereof; and a wall-mountable bracket arranged to receive said joint and having a substantially cylindrical chamber and an outwardly extending horizontal pin, said joint including a cylindrical member and a disc coaxially mounted on said pin and disposed within said chamber, said disc being formed with a cut and said cylindrical member having a longitudinal slot at an outer surface thereof, a pawl supported on said bracket and a spring arranged to press said pawl against said cylindrical member and said disc; said joint being pivotally movable on said pin within said chamber due to a swivelling movement of said supporting arm between a vertical position in which said arm is held vertically downwards by gravity and a horizontal position in which said pawl is arrested within said slot of said member and pressed against said cut of said disc to thereby provide two terminal self-locking positions of the trouser-hanger for hanging over and taking off several pairs of trousers.

2. The trouser-hanger of claim 1, wherein the width of said pawl is roughly equal to a sum of the thicknesses of said cylindrical member and said disc.

3. The trouser-hanger of claim 1, further comprising means for rotating said cylindrical element together with said disc.

4. The trouser-hanger of claim 3, wherein said rotating means include at least two stops fixed on said cylindrical member and a pin mounted on said disc and outwardly projecting therefrom, said two stops and said pin being aligned along a circular trajectory thereof upon rotation with said cylindrical member.

5. The trouser-hanger of claim 4, wherein said two stops are angularly spaced from each other so that when said arm is moved upwardly toward and reaches said horizontal position, said disc is drawn along with said cylindrical member and said pawl being released by said disc enters said slot of said cylindrical member to thereby prevent said arm from accidentally falling down and to prevent said pawl from entering said slot of said cylindrical member when said pawl is pressed against said disc, and thus allow said arm to pass beyond said horizontal position and be moved toward said vertical position.

6. The trouser-hanger of claim 5, wherein said one bar is fixedly mounted to a wall at a second end thereof to give extra resistance to said bar for opposing the loads placed on said elongated bars during said pivoting movement of said joint.

7. The trouser-hanger of claim 1, wherein five elongated hanging bars are connected to said supporting arm.

* * * * *